United States Patent [19]

Gelfort

[11] Patent Number: 4,579,635

[45] Date of Patent: Apr. 1, 1986

[54] METHOD AND APPARATUS FOR THE FIXATION OF RADIOACTIVE KRYPTON

[75] Inventor: Eike Gelfort, Hanover, Fed. Rep. of Germany

[73] Assignee: Deutsche Gesellschaft fur Wiederaufarbeitung, Fed. Rep. of Germany

[21] Appl. No.: 622,835

[22] Filed: Jun. 21, 1984

[30] Foreign Application Priority Data

Jun. 27, 1983 [DE] Fed. Rep. of Germany ..... 3323060

[51] Int. Cl.[4] ..... C25D 5/48; C23C 15/00

[52] U.S. Cl. ..... 204/35.1; 204/38.1; 204/192 C; 204/192 SP

[58] Field of Search ..... 204/192 SP, 192 C, 192 N, 204/38.1, 37.6, 35.1, 14.1, 1.5

[56] References Cited

U.S. PATENT DOCUMENTS 3,486,935 12/1969 Eyrich ..... 204/192 SP X
4,051,063 9/1977 Nelson et al. ..... 252/301.1 W
4,094,762 6/1978 Clelland ..... 204/192 EC

OTHER PUBLICATIONS

M. A. Bayne et al., Krypton Entrapment in Pulse-Biased Sputter-Deposited Metals, *Thin Solid Films*, 54 (1978), pp. 327-336.

*Primary Examiner*—Andrew H. Metz
*Assistant Examiner*—William T. Leader
*Attorney, Agent, or Firm*—Allegretti, Newitt, Witcoff & McAndrews, Ltd.

[57] ABSTRACT

A method for disposing of radioactive krypton by embedding it with radioactive palladium or molybdenum on the inner surface of a steel cylindrical container. The embedding is effected by sputtering from a glow discharge krypton plasma disposed in the annular space between a sputtering electrode arranged concentrically with the side wall of said cylindrical container which serves as the embedding electrode. The sputtering electrode is coated with radioactive palladium, molybdenum, or other metal, by electrolytically depositing said metal from a radioactive fission solution. After sputtering, the container is sealed and put in final storage. The method disposes of the radioactive metal deposited on the sputtering electrode as well as the krypton.

6 Claims, 5 Drawing Figures

METHOD AND APPARATUS FOR THE FIXATION OF RADIOACTIVE KRYPTON

The invention refers to a method and apparatus for disposing of radioactive krypton by embedding it on the inner surface of a cylinder which is subsequently sealed and permanently stored.

From the West German O/S No. 31 02 636, as well as from the publication "KrK-Nachrichten" (Vol. 14, 2/82, pp. 109–115), methods are known for the fixation of radioactive krypton as well as devices for the performance of these methods. Krypton gas at a pressure of about $10^{-2}$ torr is presented in an annular space between a metal outer cylinder, connected as the embedding electrode, and a metal inner cylinder or metal rod which is arranged concentrically in the outer cylinder and which is connected as the sputtering electrode. The sputtering electrode consists of an embedding metal, for example, titanium. A glow-discharge plasma is generated in this annular space. A high negative sputtering voltage of from 2 to 4 kV is applied to the inner cylinder, and a negative embedding voltage of only a few hundred volts is applied to the outer cylinder. By the high sputtering voltage, positive krypton ions from the discharge plasma are moved towards the sputtering electrode at high velocity. Upon encountering the sputtering electrode, metal atoms are atomized and are deposited on the inside of the outer cylinder or embedding electrode. During this sputtering of the embedding metal onto the embedding electrode, a large part of the krypton ions get embedded with it. After fixation of the radioactive krypton has been effected, or after consumption of the sputtering electrode, the cylinder arrangement is closed up into a product capable of final storage.

What is disadvantageous is that in the case of the known method and in the case of the known device for the performance of the method, additional metallic raw materials, which are usually expensive and must be consumed for the sputtering electrode, proceed to the places of final storage and form additional end storage volume.

The object of the present invention consists in developing a method of fixation of radioactive krypton on an embedding electrode in such a way that the employment of additional raw material, such as the titanium mentioned above, for the embedding metal in the sputtering electrode, is eliminated. Furthermore, a suitable device for the performance of this method is disclosed.

The object is achieved by electrolytically precipitating embedding metals out of a solution of fission product on to the sputtering electrode, and thereafter generating a plasma of the krypton and depositing it on an embedding electrode with the embedding metal. A device for the performance of the method comprises a first cylindrical electrode, a second concentric electrode, and an annular space therebetween for receiving the solution of fission product. By forming a sputtering electrode by precipitating a radioactive embedding metal out of a solution of fission product, instead of providing a finished sputtering electrode from nonradioactive embedding metal, a small amount of cheap metal may be employed, both as electrode carrier material and for fixing the krypton in the embedding metal through the generation of krypton plasma.

In accordance with the invention, radioactive metals obtained from the processing of the fission product may in a simple and profitable manner be utilized directly as embedding metals. Through the utilization of these radioactive metals for the fixation of the krypton, expensive and wasteful final storage volume may be saved, firstly because the radioactive embedding metals no longer need to be fed separately to final storage, and secondly because additional raw materials for the sputtering electrode are no longer necessary and therefore no longer are sent to the places of final storage.

The preferred metals that are precipitated from the solution of fission product on to the sputtering electrode comprise palladium and molybdenum; others include zirconium, niobium, technetium, ruthenium, rhodium or any combination of these metals. The method in accordance with the invention makes possible the build-up of the sputtering electrode out of a number of embedding metals or embedding metal alloys. The metals and metal alloys may be unpurified. As compared with the state of the art, it is no longer necessary to employ pure (radioactive) metals. The precipitation of the embedding metal out of the solution of fission product may be effected electrolytically in a simple manner.

The generation of a plasma, necessary for the fixation of the krypton, may be effected in a manner in itself known through gas discharge in the krypton atmosphere.

The device in accordance with the invention is advantageously constructed in such a way that after the fixation of the krypton or the consumption of the embedding metal, it may serve directly as the container for final storage.

The device in accordance with the invention serves in the first step of the method as the electrolysis tank for receiving the solution of fission product as electrolyte. The outer and inner cylinders in this step of the method are connected as electrodes for the electrolysis. After completion of the electro-chemical precipitation of the embedding metal upon the central sputtering electrode, the device in accordance with the invention serves in the further steps of the method for receiving the krypton atmosphere, for the generation of a krypton discharge plasma, and for the performance of the process of fixation of the krypton.

The invention is now to be explained in greater detail with the aid of the attached drawings, in which FIG. 1 is a device in accordance with the invention in diagrammatic perspective as the electrolysis apparatus at the start of the electrolytic precipitation of radioactive metal out of a solution of fission product on to an inner cylindrical electrode for the formation of a sputtering electrode;

Figure 1:
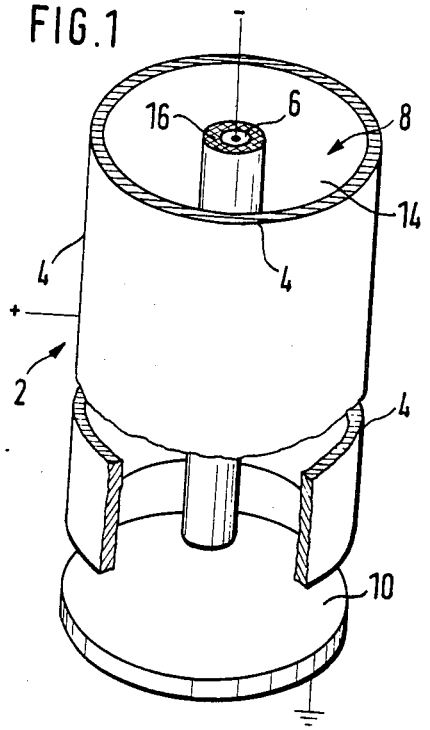

The drawing shows a device essentially in the form of a container 2 having an outer cylinder 4 and an inner cylinder 6 between which an annular space 8 is formed.

Figure 5:
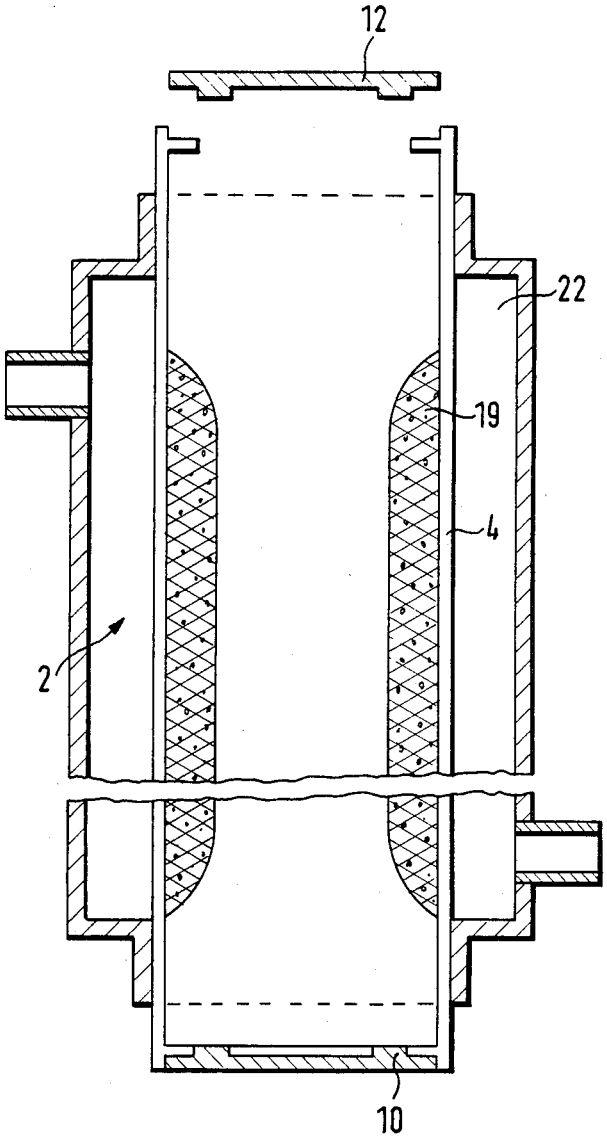
FIG. 5 shows the device in accordance with the invention as in FIG. 4 in vertical section, completed by a cooling device and means of final storage.

The outer and inner cylinders are connected as electrodes. The container has a bottom 10 and can be closed off at the top by means of a cover 12 (FIG. 5).

Figure 2:
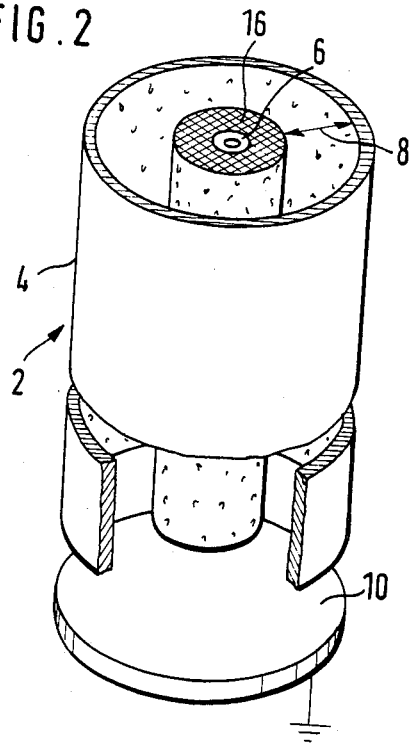
FIG. 2 shows the device in accordance with the invention as in FIG. 1, after electrolytic precipitation of the metal has been effected.

In FIGS. 1 and 2, the container 2 is being used as an electrolysis apparatus into the annular space 8 of which a solution 14 of fission product is filled as electrolyte, out of which through the application of a voltage (inner cylinder negative and outer cylinder positive), radioactive embedding metals are precipitated on to the inner cylinder electrode 6 until an adequately thick coating 16 of embedding metal is built up (FIG. 2). The outer and inner cylinders consist, for example, of steel.

In FIG. 1, the container 2 is shown at the start of the electrolytic process. A thick coating 16 of embedding metal has already formed on the inner cylinder. FIG. 2 shows the final state in which the coating 16 of embedding metal has been completely developed.

Figure 3:
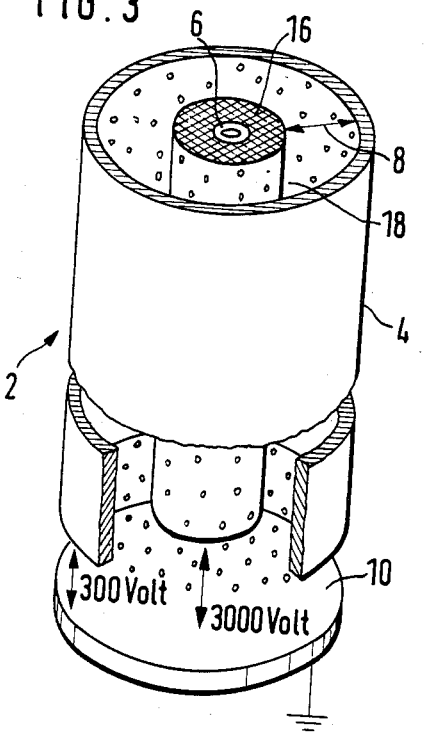
FIG. 3 shows the device in accordance with the invention as in FIGS. 1 and 2 in diagrammatic perspective as the sputtering device for the fixation of krypton at the start of the embedding of the krypton in the embedding metal upon an outer cylindrical embedding electrode.
Figure 4:
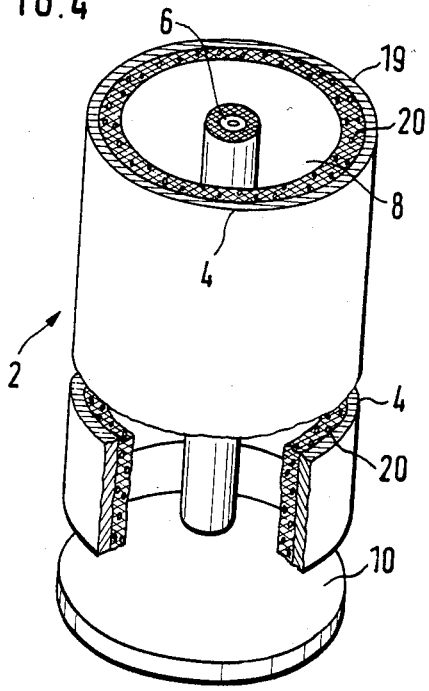
FIG. 4 shows the device as in FIG. 3 after sputtering has been effected with fixation of the krypton.

FIGS. 3 and 4 show the device in accordance with the invention as a sputtering device in which the initial state of the device is as in FIG. 2. The inner cylindrical coating 16 of the embedding metal is connected as the sputtering electrode. A negative voltage of from 2 to 3 kV is applied to this sputtering electrode. The outer cylinder 4 is connected as the embedding electrode. A negative embedding voltage of only a few hundred volts is applied to it. In the annular space 8 between the outer cylinder 4 and the sputtering electrode 16, a krypton atmosphere 18 is built up at a krypton pressure of about $10^{-2}$ torr. For the generation of a krypton plasma in the annular space 8, a glow discharge is ignited, for which structural details are not shown, since such a glow discharge in a cylindrical arrangement of the present kind is of the state of the art.

By the high negative sputtering voltage of from 2 to 3 kV positive krypton ions are accelerated out of the discharge plasma towards the sputtering electrode 16 which the krypton ions encounter at high velocity and gradually atomize the embedding metal. The atomized metal gets caught on the inside of the embedding electrode, outer cylinder 4. A great part of the krypton ions encountering the embedding electrode also get embedded in the growing layer 19 of the radioactive embedding metal, that is, in the form of minute bubbles 20 as is shown diagrammatically in FIG. 4. After fixation of the krypton has been effected on the embedding electrode 4, the greater part of the embedding metal 16 has been consumed from the sputtering electrode as may likewise be understood diagrammatically from FIG. 4.

In the case of this fixation of krypton through glow discharge and metal sputtering, concentrations of up to 200 standard liters of krypton per liter of embedding metal are achieved.

As the embedding metal for the sputtering electrodes or the coating 16 of the inner electrode 6, radioactive palladium or radioactive molydbenum are preferably chosen out of the solution of fission products. But other radioactive metals from the solution of fission products, such as zirconium, niobium, technetium, ruthenium, or rhodium or combinations of these metals with or without radioactive palladium and/or radioactive molybdenum, may be chosen as the sputtering electrode. Furthermore, radioactive metal alloys, too, are suitable as the material of sputtering electrodes.

The electric power expended in the fixation of krypton by flow discharge and metal sputtering may, if necessary, be dispersed by water cooling of the cylindrical electrodes, in particular of the outer cylindrical electrode 4, as is shown diagrammatically in FIG. 5, in which the outer cylinder 4 is surrounded by a cooling water jacket 22.

FIG. 5 shows the container 2 after completion of the fixation of krypton. The container can then be passed directly to final storage after the cover 12 of the cylinder has been secured, for example, by welding.

I claim:

1. In a method for embedding radioactive krypton ions in atomized embedding metal on the surface of an embedding electrode by generating a krypton plasma in the space between a sputtering electrode and said embedding electrode, from which plasma krypton ions strike the sputtering electrode at high velocity to sputter off embedding metal which is deposited on the embedding electrode with krypton ions, the improvement comprising (a) first introducing a solution of fission product between said sputtering electrode and said embedding electrode;

(b) electrolytically precipitating at least one radioactive embedding metal from said solution directly on to said sputtering electrode;

(c) removing the solution from said electrodes;

(d) subsequently bringing the electrodes into an atmosphere of radioactive krypton; and (d) generating a krypton plasma to effect embedding of embedding metal and krypton ions on said embedding electrode.

2. The method of claim 1 in which said radioactive embedding metal is palladium, molybdenum, or mixtures thereof.

3. The method of claim 1 in which said radioactive embedding metal is radiodactive zirconium, niobium, technitium, ruthenium, rhodium, or radioactive alloys thereof.

4. The method of claim 3 in which said metals are precipitated together with radioactive palladium or radioactive molybdenum, or both.

5. The method of claim 1 in which said plasma is generated by gas discharge in the krypton atmosphere.

6. The method of claim 1 in which the amount of krypton deposited is at least about 200 times the volume of embedding metal.

* * * * *